US005913341A

United States Patent [19]

Jones

[11] Patent Number: 5,913,341

[45] Date of Patent: Jun. 22, 1999

[54] APPARATUS AND METHOD FOR TYING AT LEAST TWO BARS

[75] Inventor: Cecil Gwilliam Jones, Wynnum, Australia

[73] Assignee: Ironbar Pty Ltd., Australia

[21] Appl. No.: 08/746,149

[22] Filed: Nov. 4, 1996

Related U.S. Application Data

[63] Continuation of application No. 08/481,375, filed as application No. PCT/AU93/00652, Dec. 14, 1993.

[30] Foreign Application Priority Data

Dec. 14, 1992 [AU] Australia ..... PL6325

[51] Int. Cl.[6] ..... B21F 7/00; B21F 9/02; B25B 25/00; E04G 21/12

[52] U.S. Cl. ..... 140/119; 140/57; 52/749.1; 52/741.1; 52/750; 52/719; 52/712

[58] Field of Search ..... 52/719, 712, 665, 52/749.1, 741.1, 750; 140/119, 53, 54, 57; 24/27

[56] References Cited

U.S. PATENT DOCUMENTS

| | | | |
|---|---|---|---|
| 1,512,763 | 10/1924 | Holmgreen . | |
| 3,132,396 | 5/1964 | Berman | 24/27 |
| 3,169,559 | 2/1965 | Working | 140/119 |
| 3,234,616 | 2/1966 | Wautland | 24/27 |
| 3,302,348 | 2/1967 | Pratt . | |
| 3,786,841 | 1/1974 | Albrecht et al. | 140/119 |
| 4,483,119 | 11/1984 | Hernandez | 52/589 |
| 4,798,231 | 1/1989 | Glaus et al. | 140/119 |
| 5,094,567 | 3/1992 | Glaus et al. | 24/27 |
| 5,431,196 | 7/1995 | Forrester et al. | 140/119 X |

FOREIGN PATENT DOCUMENTS

| | | | |
|---|---|---|---|
| 1005821 | 4/1952 | France . | |
| 2720212 | 11/1977 | Germany | 52/665 |
| 0718021 | 10/1966 | Italy | 52/665 |
| 5163797 | 6/1993 | Japan . | |
| 0295590 | 3/1954 | U.S.S.R. . | |
| 1036300 | 8/1983 | U.S.S.R. . | |
| 9206260 | 4/1992 | WIPO . | |
| 9221839 | 12/1992 | WIPO . | |
| 9302816 | 2/1993 | WIPO . | |

*Primary Examiner*—Robert Canfield
*Attorney, Agent, or Firm*—Blakely, Sokoloff, Taylor & Zafman LLP

[57] ABSTRACT

A tie device (1) is provided, for tying objects together, such as reinforcing bars (7, 8) prior to pouring concrete there-around. The tie device (1) comprises a pair of arms (2, 3) in a U- or V-shaped configuration, and has a hook (5, 6) at each end thereof. The hooks (5, 6) are designed to automatically interengage when brought together. An apparatus and method for tying the tie device (1) are also provided.

13 Claims, 15 Drawing Sheets

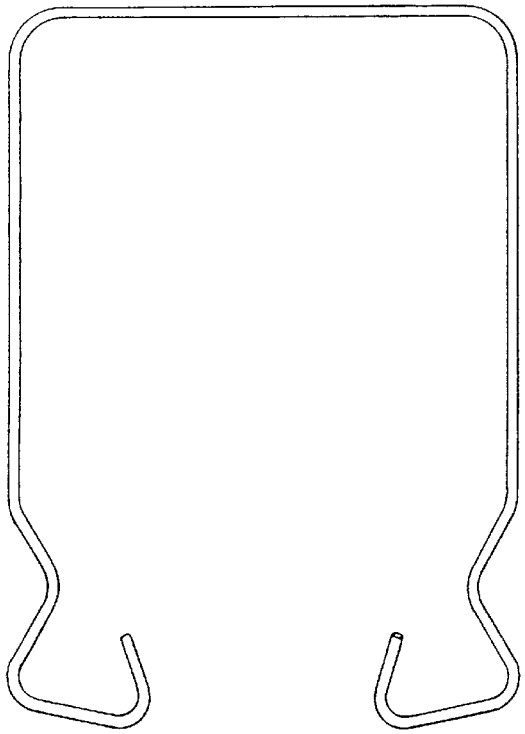
FIG. 2(a)
FIG. 2(b)
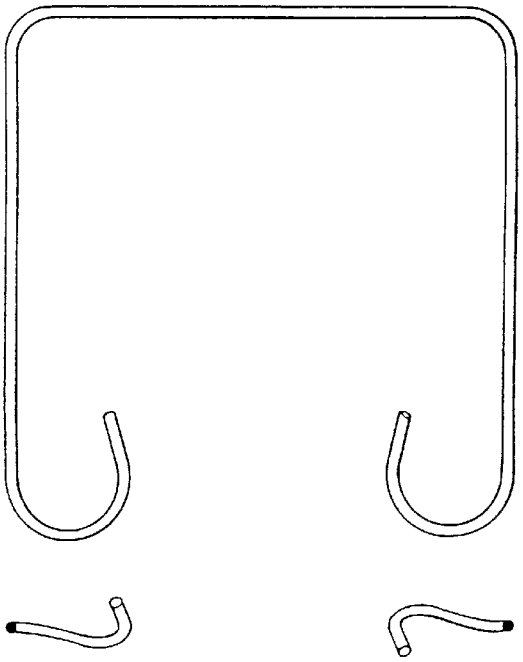
FIG. 3(a)
FIG. 3(b)

APPARATUS AND METHOD FOR TYING AT LEAST TWO BARS

This is a continuation of application Ser. No. 08/481,375 filed Jun. 13, 1995, which is a 371 of PCT/AU93/00652, filed Dec. 14, 1993.

BACKGROUND OF THE INVENTION

The present invention relates to a tie device, to tying apparatus and to methods for tying using said tie device, and in particular, to a tie device and apparatus and method which enables reinforcing bars or mesh, typically used in the construction industry, to be quickly and securely 'tied'.

Concrete used in the building industry has a high resistance to compressive forces, but a relatively low tensile strength. Steel bars, on the other hand, have high tensile strength, so therefore it is common practice to reinforce the concrete with such steel bars to provide the necessary resistance to tension forces. In order to achieve the required strength of the resultant concrete member, the reinforcing bars need to be accurately positioned and retained in position whilst the concrete is being poured into the formwork. In many structural members, for example, slabs, beams, columns and walls, the steel bars are laid at right angles to each other to form a grid.

It is common practice to secure the bars, where they cross, by manually tying them together with tie wires, that is, by looping the wire around the bars and twisting the free ends of the wire together. Standard pliers, or pliers designed to facilitate the twisting of the wire, are used. This practice however has serious shortcomings. It is labour intensive and time consuming, resulting in significant direct costs. Indirect costs also result, since the next stage of construction cannot be started until the concrete structural component is completed. Additionally, because of the amount of kneeling and bending involved, particularly in large slab construction, injuries to the knees and backs of workers is commonplace.

There are no known machines on the market which will perform this work, although various unsatisfactory attempts have been made over the years to produce such a machine or tool.

For a wire tying tool to be useful and therefore accepted in the industry, it must be safe, reliable, convenient to use, and commercially attractive (ie. reasonable price and effective in reducing overall costs).

SUMMARY OF THE INVENTION

The present invention seeks to overcome the disadvantages of such prior art connection methods of tying reinforcing bars, by providing an apparatus, and it's associated method of operation, wherein the tying operation is automatically achieved by providing an apparatus and method, wherein, a wire tie device is provided at the tie location, and is then automatically twisted around the bars to effect connection of same.

The present invention also seeks to provide a uniquely designed tie device useful for tying about said reinforcing bars and which readily tied by either by conventional manual methods or by such a tying apparatus.

In one broad form the present invention provides a tie device constructed of substantially ductile material, comprising:

a pair of elongate arms extending from an intermediate portion of said device in a substantially U- or V-shaped configuration; and, hook means provided at the end portion of each said arm;

whereby, at least one of said hook means is shaped to at least partly extend out of the plane of the remainder of said tie device, such that, upon application of an inward force, said hook means move together and automatically interengage, and, upon subsequent release of said force, said hook means remain interengaged in a connected position.

In a preferred form said shaped hook(s) is/are of substantially a spiral shape, or other gradual smooth shape.

In an alternative form said shaped hook(s) is/are shaped having at least one defined bend or corner.

Preferably, in use, after said hook means are in said connected position, said device is adapted to be twisted such that is is tightened about one or more object(s) to be tied.

Most preferably, said device is used for tying two or more reinforcing bars together.

In a further broad form, the present invention provides a tying apparatus for tying a tie device about one or more object(s) to be tied, said tie device characterised in being substantially U- or V-shaped and having hook means at the end portions thereof, said tying apparatus comprising:

delivery means, to deliver said tie device to a tying position substantially about said object(s);

connecting means to interengage and connect said hook means; and, twisting means to twist and thereby tighten said tie device about said object(s).

Preferably, said delivering means comprises:

a magazine to contain a plurality of said tie devices and dispense each tie device, one at a time; and, transfer means to move said tie device to a tying position substantially about one or more object(s) to be tied.

Also, preferably, said connecting means comprise a pair of couplers, one for each hook means of said tie device, each coupler adapted to cooperate with and move its respective hook means for interengagement with the other of said hook means.

In a preferred form said twisting means is adapted to operatively engage with part of said tie device after it is positioned about and when it substantially encircles said object(s), and twist said tie such that it is tightened about said object(s).

Preferably, each of said delivery means, said connecting means, and said twisting means are mechanically, hydraulically, pneumatically, electrically and/or electromechanically operated.

In a preferred embodiment of the invention, the device is provided with an elongate handle for holding/operating said device.

Most preferably, the device is used for tying two or more reinforcing bars together.

In a further broad form, the present invention provides a method of tying a tie device about one or more object(s) to be tied, characterised in that said tie device is a substantially U- or V-shaped device having hook means at the end portions thereof, said method comprising the steps of:

providing each tie device, one at a time, substantially about one or more object(s) to be tied;

interengaging and connecting said hook means; and, twisting and tightening said tie device about said object (s).

Preferably, said providing step comprises delivering each tie device from a dispenser/magazine having a plurality of tie devices stored therein and transferring each device to a tying position substantially about said object(s) to be tied.

Most preferably, said interengaging and connecting step comprises utilising a pair of couplers, one for each hook means of said tie device, to cooperate with and move its respective hook means relative to the other of said hook means such that the hook means interengage and connects with the other of said hook means.

Also preferably, said twisting and tightening step comprises operatively engaging part of said tie device after it is positioned substantially about and encircles said object(s) and then rotating said engaged part of said tie device such that it becomes twisted and tightened about said object(s).

Preferably, each or all steps are performed by mechanical, hydraulic, pneumatic, electrical and/or electro-mechanical or otherwise operated means.

The most preferred form of the device is used for tying two or more reinforcing bars together.

BRIEF DESCRIPTION OF THE DRAWINGS

The present invention will become more fully understood from the following detailed description of a preferred but non-limiting embodiment thereof, in connection with the accompanying drawings, wherein:

FIG. 2 illustrates, in FIGS. 2(*a*) and 2(*b*) thereof, elevational and underside views, respectively, of an alternative embodiment of the device;

FIG. 3 illustrates, in FIGS. 3(*a*) and 3(*b*) thereof, elevational and underside views of yet a further embodiment of the tie device;

DETAILED DESCRIPTION OF THE PREFERRED EMBODIMENTS

Figure 1A:
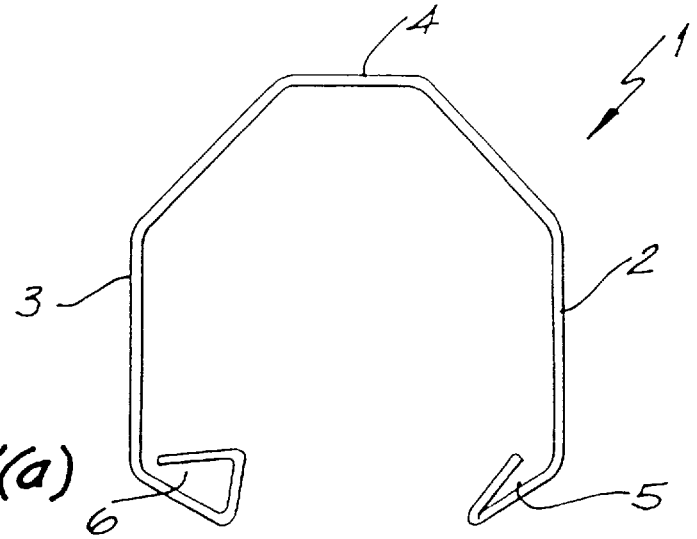
FIG. 1 shows, in FIGS. 1(*a*), 1(*b*), 1(*c*) and 1(*d*), elevational and underside views of the tie device in the open position, and elevational views of the device in the connecting position and the connected position, respectively.
Figure 1B:
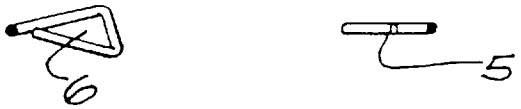

In the drawings, like numerals identify similar features.

A preferred embodiment of a tie device is shown in FIG. 1 and generally designated by the numeral 1. The tie device 1 is preferably constructed of a substantially ductile material, such as metal, and is provided in a thin wire like formation. Of course, any other suitable material, such as plastic, and any other cross-sectional shape may be utilised. Basically, the tie device comprises a pair of elongate arms 2 and 3, extending from an intermediate portion 4 thereof in a substantially U- or V-like configuration. Hook means 5 and 6 are provided at each end portion of each arm 2 and 3, respectively. It will be noted that the tie device depicted in FIG. 1 is provided with hook means 5 and 6 of different shape, the hook 5 being of a two bends, bent back in the same plane as the remainder of the device 1, whilst the hook 6 has three bends, and extends out of the plane of the remainder of the tie device 1. The purpose for at least one of the hooks, in extending out of the plane of the remainder of the device 1, is such that "automatic" engagement of the two hooks may occur upon application of an inward force, as will be described hereinafter. FIG. 1*b* perhaps better illustrates the "out of plane" bending of the hook 6 shown in FIG. 1*a*.

Figure 1C:
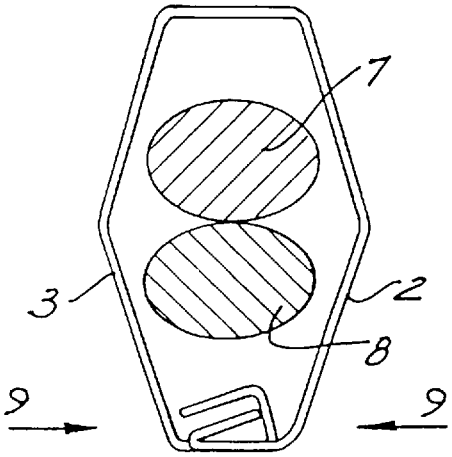
Figure 1D:
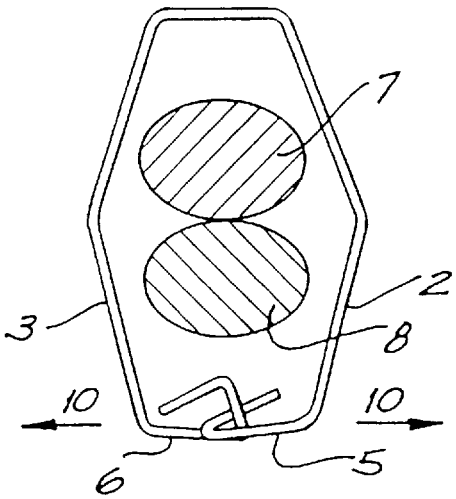

In use, the hook may be utilised to tie a pair of reinforcing bars 7 and 8, as depicted in FIGS. 1*c* and 1*d*. Once the hook is appropriately positioned around the objects to be tied, the hook portions 5 and 6 are moved in the direction of arrows 9 as shown in FIGS. 1*c* such that they "overlap". Then, upon subsequent release of the force, and due to the resilient nature of the material utilised in construction of the tie device, the arms 2 and 3 together with their respective hooks 5 and 6 move outwardly in the direction of arrows 10 as shown in FIG. 1*d*. In such position they therefore remain interengaged in the connected position. The hooks are shaped such as to not thereafter release from such connected position.

Other shapes of hooks may be utilised, either of a twisted or spiral shape or other gradual smooth shape, or, of a more defined bend or corner. Examples of such tie devices are shown in FIGS. 2 and 3 respectively, FIG. 2 illustrating an alternative version of a tie device having defined bends or corners, and FIG. 3 illustrating a smoother twisted shape. Either one or both hooks may be twisted or bent.

It will however be appreciated that gradual twisting or spiralling, rather than more defined bending, may allow the tie devices to nest more compatibly when provided with a plurality of other like tie devices in a magazine or the like.

It will be appreciated that the essential criteria in designing such alternative shaped tie devices is that they should be of appropriate characteristics and shape that, when pushed together in the direction of arrows 9 in FIG. 1*c*, and then subsequently released to move in the direction of arrows 10 in FIG. 1*d*, the hook portions 5 and 6 of the tie device 1 become interconnected. Other important and preferable features are that they nest so that they can be placed in a dispenser/magazine and delivered without becoming entangled, and, that the hooks are shaped such that when they interconnect around the objects to be tied, they provide a reliable anchorage against which the device is tightened.

Figure 4A:
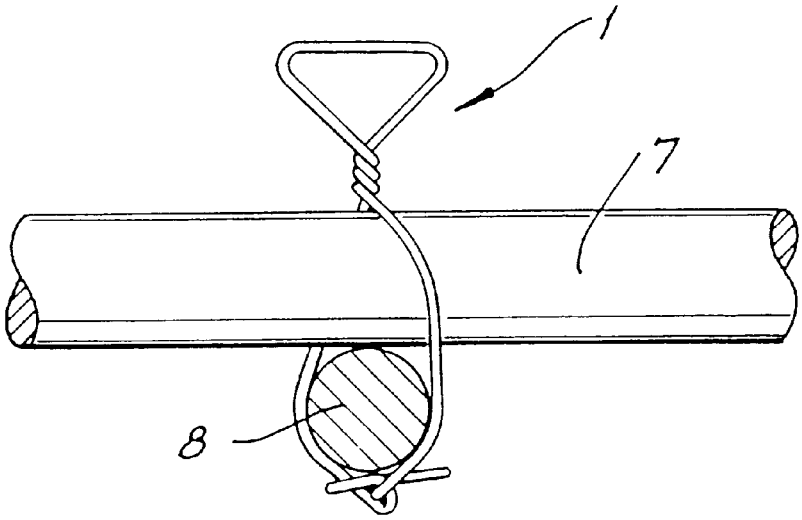
FIG. 4 shows in FIGS. 4(*a*) and 4(*b*) thereof respectively, elevational and underside views of the tie device of FIG. 1, but in a connected/tied position.
Figure 4B:
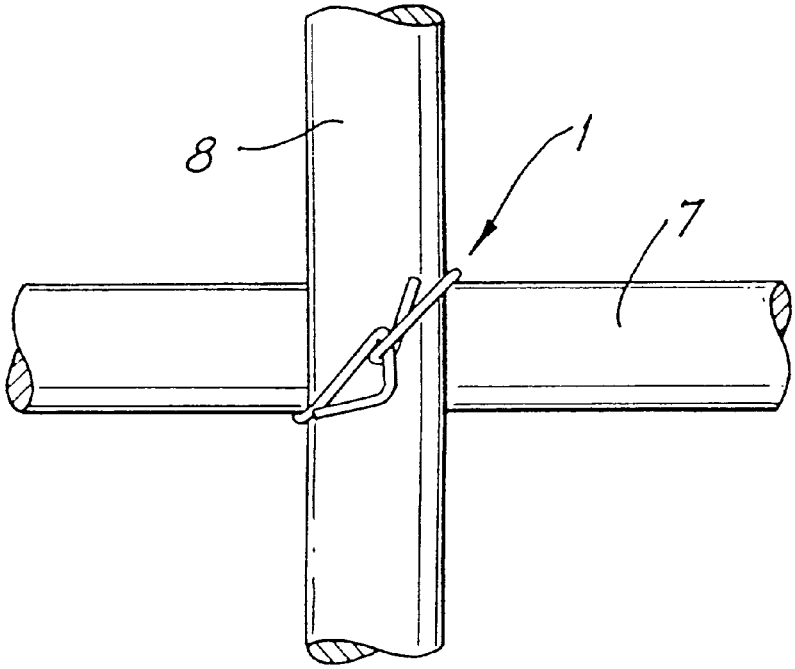

As illustrated in FIG. 4, which show elevational and underside views of the tie device, once connected about the objects to be tied 7 and 8, the tie device 1 is twisted such that the objects 7 and 8 become securely fastened together so that they cannot disengage.

The present invention also relates to a manual and/or automatic apparatus and method for effecting the supply, connection and twisting of these tie devices 1 about the objects to be tied 7 and 8. Details of the apparatus and the method for achieving this purpose will be hereinafter described.

Figure 5A:
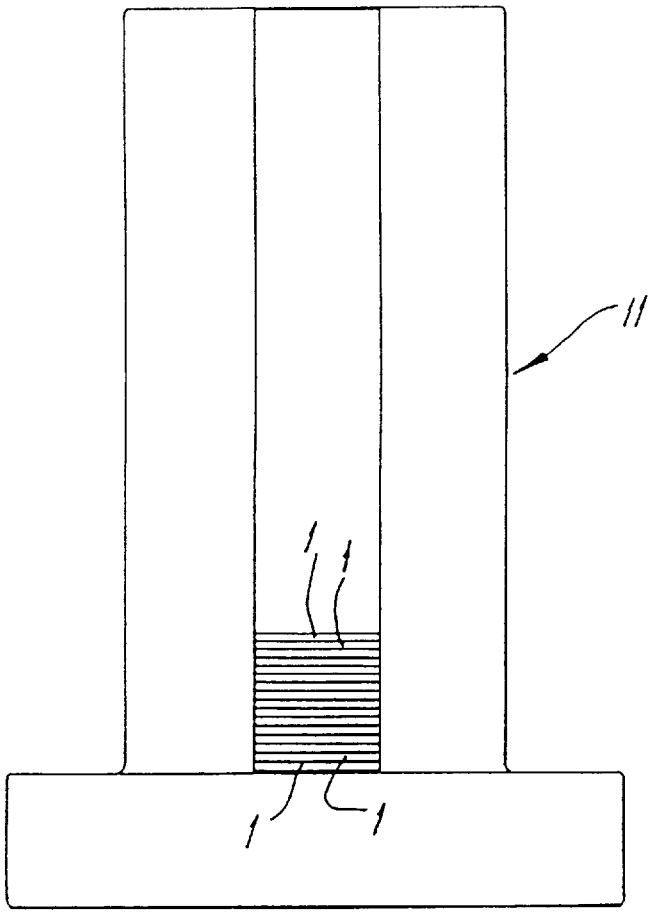
FIG. 5, in FIGS. 5(*a*) and 5(*b*), shows elevational and top views of a dispenser for housing/dispensing a plurality of tie devices.
Figure 5B:
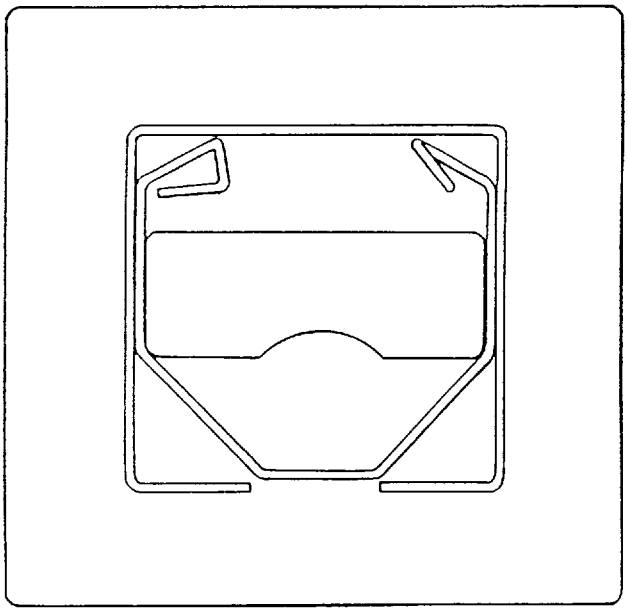

A suitable dispenser to store/supply the tie devices is shown in FIG. 5, FIG. 5*a* illustrating an elevational view thereof, and FIG. 5*b* illustrating a plan view thereof. As shown, the dispenser is provided with a plurality of tie devices 1 stacked therein.

Figure 6B:
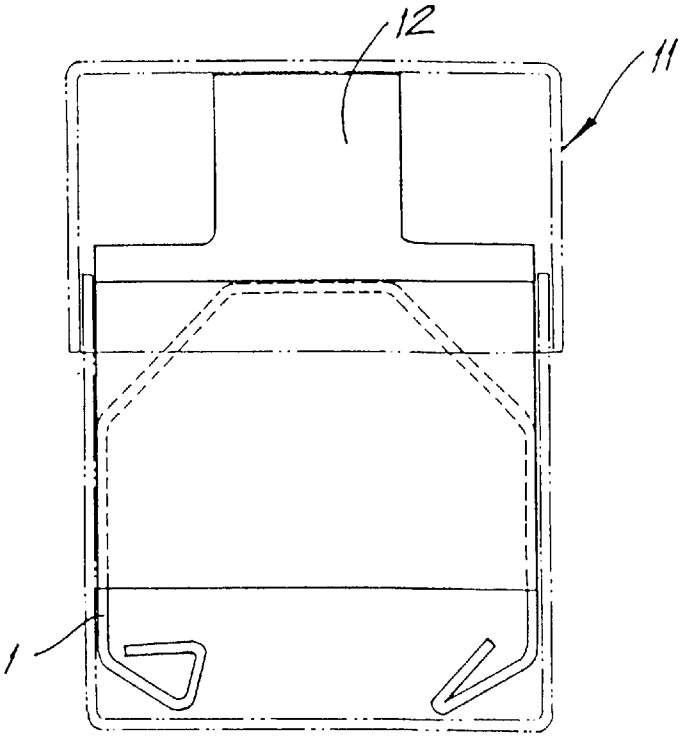
FIG. 6, in FIGS. 6(*a*) and 6(*b*), detail the inner operation of the magazine, showing side and front views thereof respectively housing a plurality of tie devices to deliver each tie device one at a time.
Figure 6A:
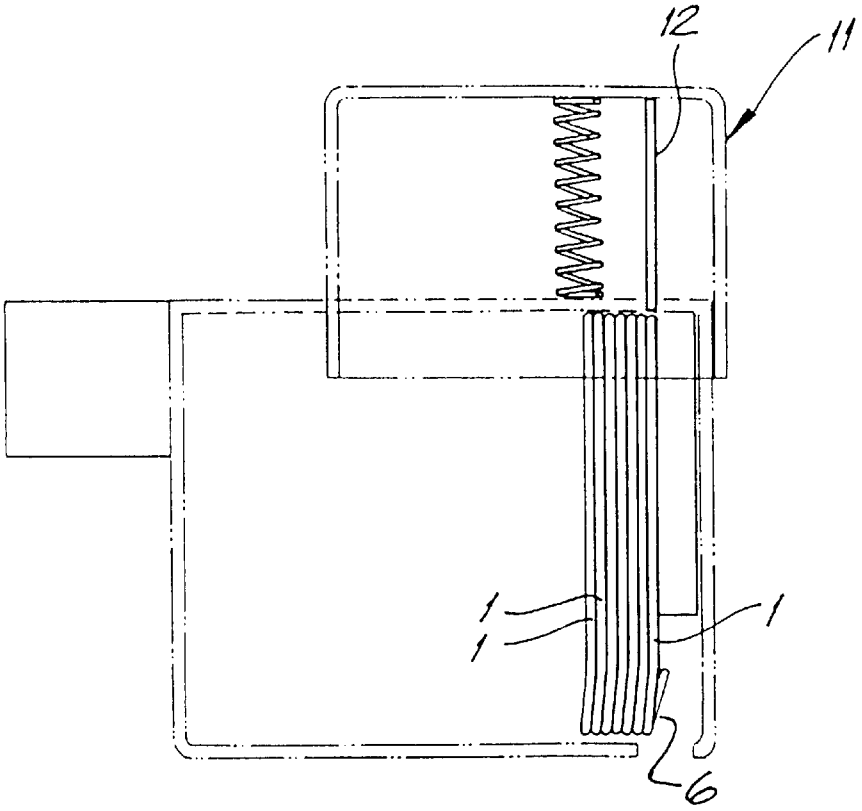

FIG. 6 illustrates the operation of a magazine 11, whereby each tie device may be selectively removed, one at a time. Attention is drawn to the guillotine like device 12, which "ejects" each tie device 1 from the magazine 11, one at a time. The magazine/dispenser allows supply of each tie device without becoming tangled.

Figure 7:
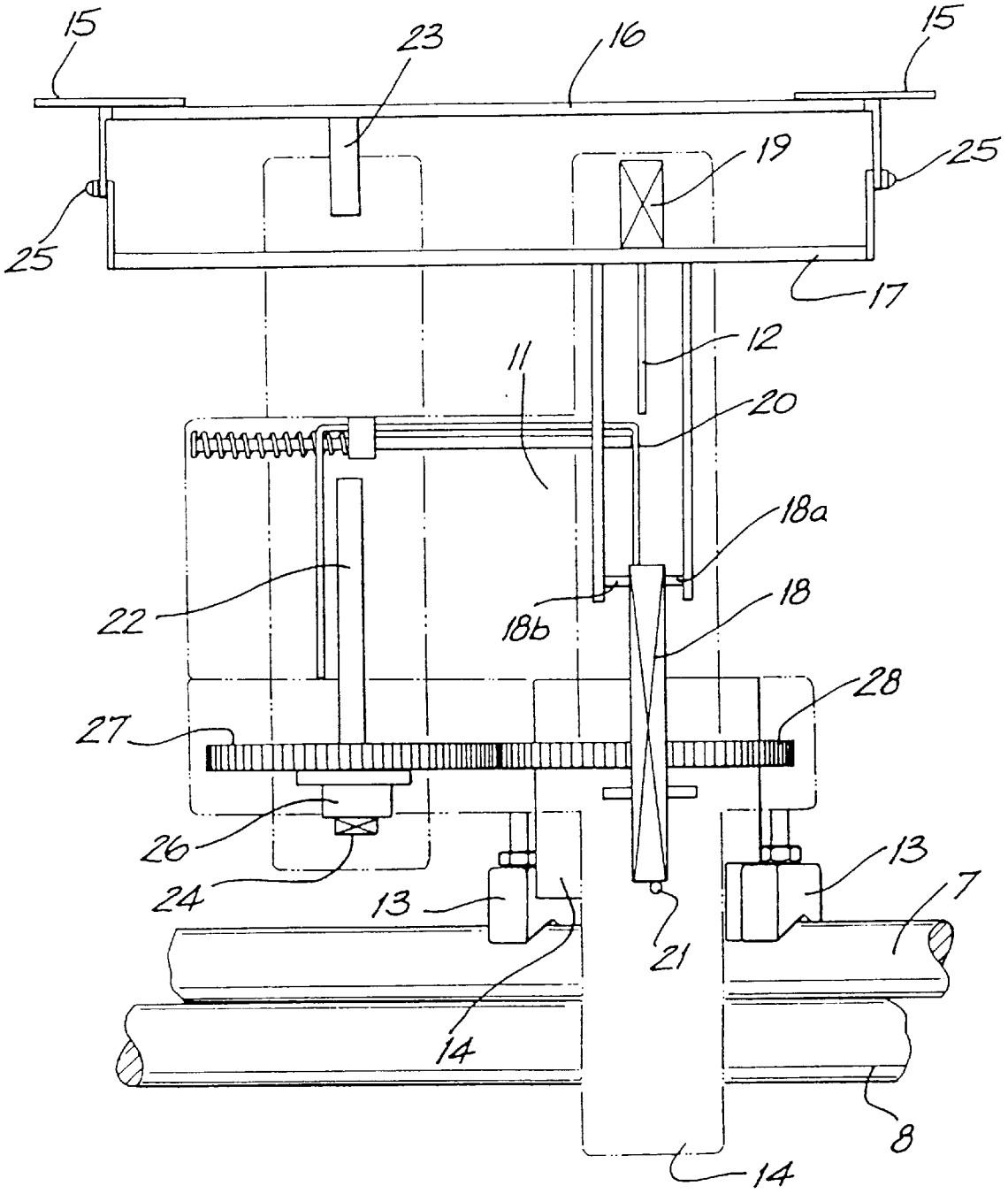
FIG. 7 shows a mechanical embodiment of a tying apparatus in accordance with the present invention.
Figure 8:
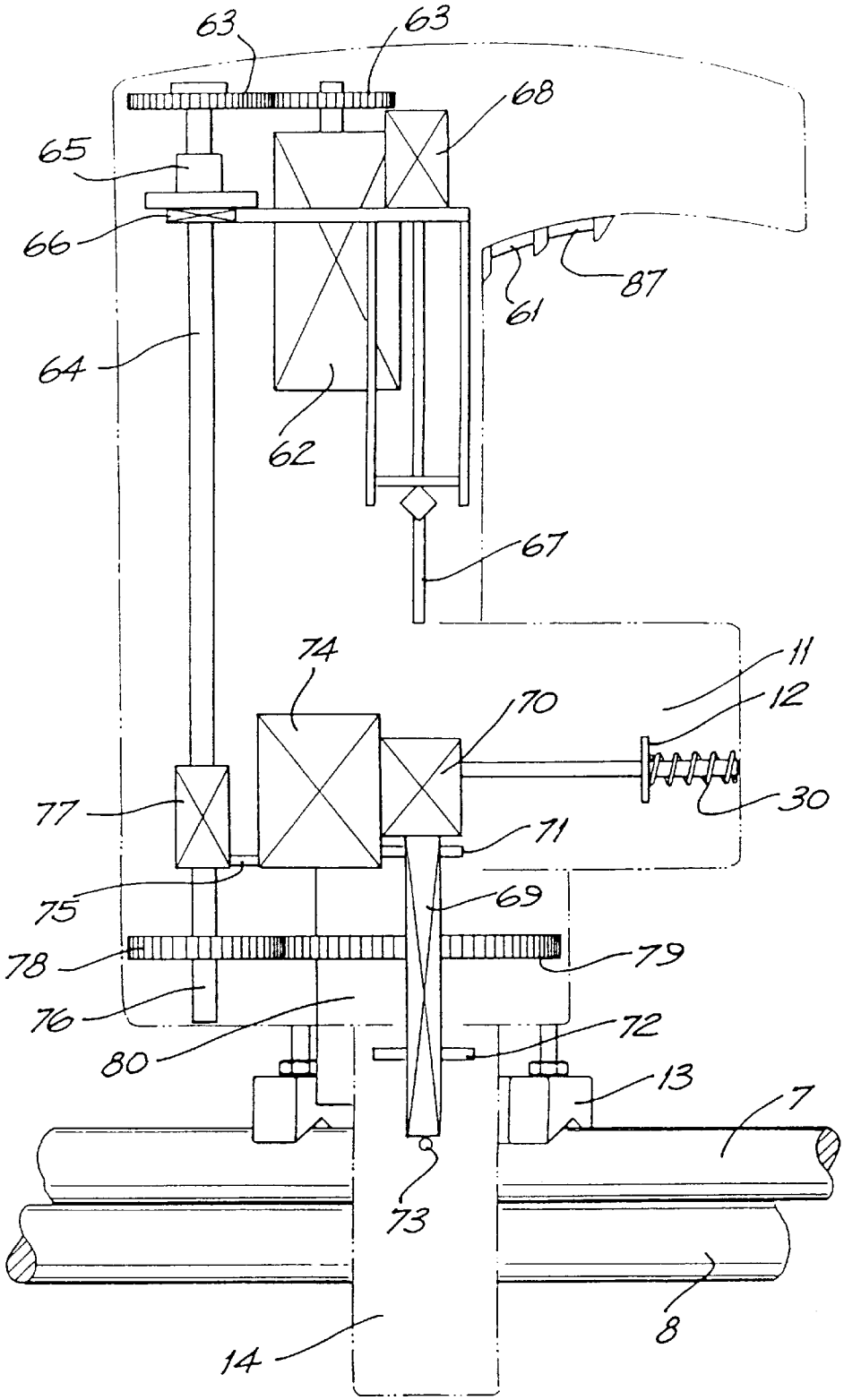
FIG. 8 shows an electrical embodiment of a tying apparatus.
Figure 9:
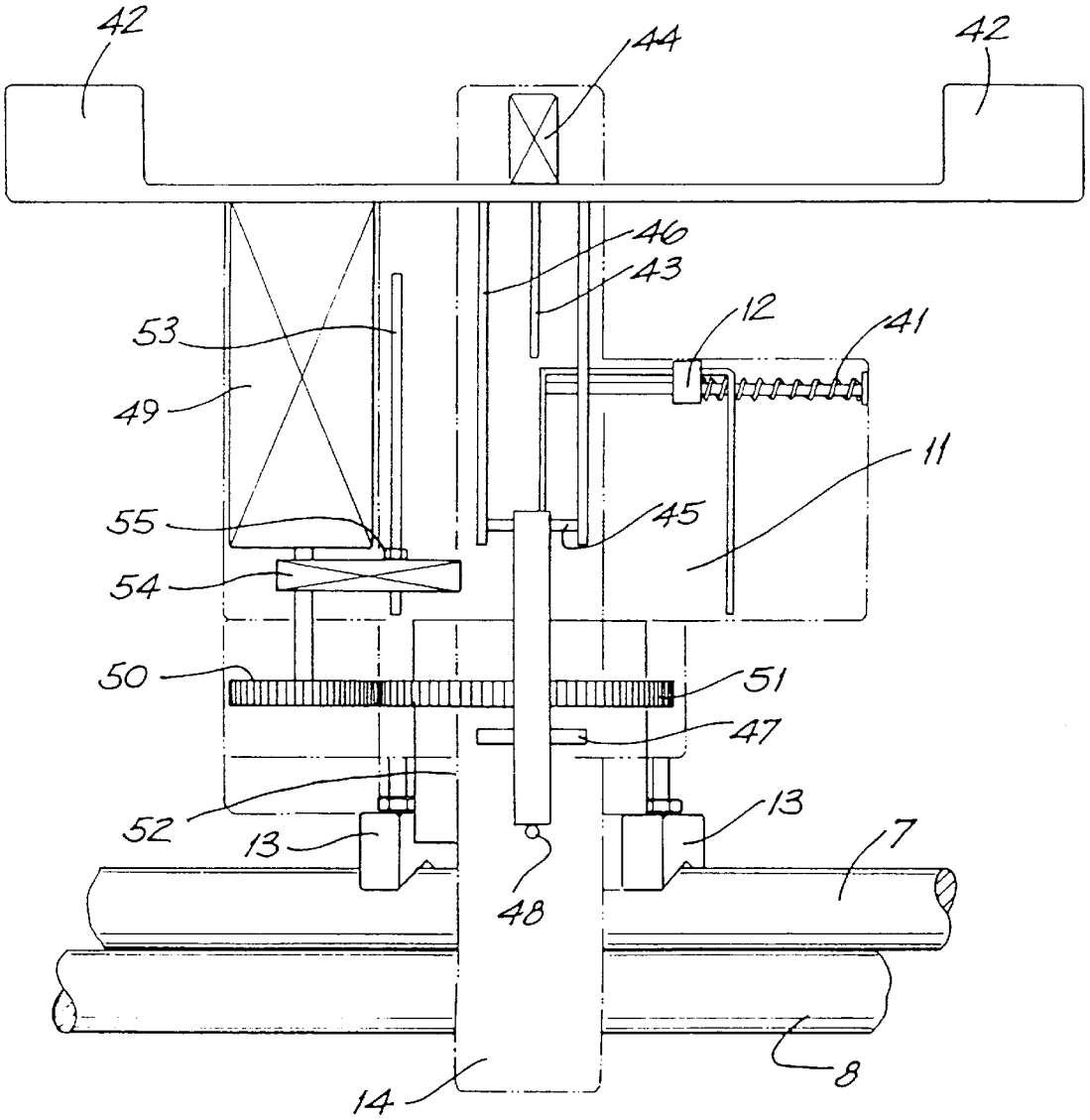
FIG. 9 shows an electromechanical embodiment of the tying apparatus.

FIGS. 7, 8 and 9 illustrate different embodiments of tying apparatus in accordance with the present invention, FIG. 7 illustrating a mechanical machine, FIG. 8 illustrating an electromechanical machine and FIG. 9 illustrating an electrical machine. It will be appreciated that any combination of mechanical, hydraulic, pneumatic, electrical, and/or electromechanical or otherwise device may be utilised to implement the the tying operation of the present invention. Basically, a tying apparatus for tying a tie device about one or more objects to be tied comprises a deliver means to deliver each tie device to a tying position substantially about the objects to be tied, a connecting means to effect interengagement and connection of the hook portions of the tie device, and a twisting means to twist and thereby tighten the tie device about the object. The resultant tied tie device 1 should therefore appear as shown in FIG. 4.

The operation of the mechanical machine, shown in FIG. 7, will now be described.

A stack of tie devices 1 is provided within the magazine 11. The machine is placed diagonally and approximately centrally across the bars 7 and 8 with the saddles 13 resting on the top bar 7 and the coupler guide housing 14 straddling the bars 7 and 8.

The handles of the machine 15 are pressed down to move the top frame 16 and the bottom frame 17 in a downwards position. The shear blade or guillotine 12 connected to the bottom frame 17 shears the front tie device 1 from the stack thereof in the magazine 11 and delivers it to the couplers 18. The shear blade or guillotine 12 stops at this position being released from the bottom frame 17 by the engage release catch 19. At this same position, the coupler pivots 18*a* are engaged by the coupler drive plates 20 also connected to the bottom frame 17. As the handles continue to be pressed down, the couplers are driven down with the tie device now secured in the couplers. Relative positions of the coupler pivots 18*a* and 18*b* in the coupler guides control movement of the couplers, to position the tie device 1 around the bars 7 and 8 and bring the hooks together for coupling with the top of the loop formed resting on the twist rods 21. The down movement of the handles 15 is stopped at this position.

This down movement of the handles brings the top frame 16 into contact with screw shaft 22 through the drive rod 23 connected to the top frame and the arm 24 connected to the screw shaft 22. The top frame 16 is released from the bottom frame 17 by a finger control 25. The handles are continued to be pressed down to move the top frame down to the bottom frame. The screw shaft is driven down through the screw nut 26 which rotates. The screw nut, which is connected to the drive gear 27 rotates the drive gear and in turn the twist gear 28, its hollow shaft 80 and the twist rods 21 which are connected to the hollow shaft. The twist rods 21 twist the tie device 1 to form the tie. The screw shaft moves down against a spring and is locked down by a catch. With the tie device twisted and the twist rods now held firmly in the top loop that has been formed, the handles are pulled up so that the top and bottom frames are returned to their original positions.

At the end of this upward travel, the catch holding down the screw shaft is automatically released. The screw shaft moves up to reverse the direction of rotation of the screw nut and in turn the twist rods which spin the twist rods clear of the tie device allowing the machine to be removed. The twist shaft, hollow shaft and twist rods are returned to their original positions ready to receive the next tie device and the procedure is repeated.

Operation of an electrical machine, as depicted in FIG. 8, will now be described.

A stack of tie devices 1 is placed in the magazine 11 in front of the magazine drive plate 142 and its drive spring 30. The machine is placed diagonally and approximately centrally across the bars 7 and 8 with the saddles 13 resting on the top bar 7 and the coupler guide housing 14 straddling the bars 7 and 8.

The start switch 61 is pressed, which starts the D.C. gear-motor 62 and rotates the pair of gears 63. The gears 63 rotate the screw shaft 64 which drives the screw nut 65 down.

The carrier arms 66 are connected to the screw nut 65 and the shear blade or guillotine 67 through the engage/release catch 68. The shear blade 67 shears the front tie device 1 from the stack of tie devices and delivers it to the pair of couplers 69.

The shear blade stops at this position, being released from the carrier arms by the engage/release catch. The carrier arms engage the coupler engage/release catch 70 at this position and drive the couplers down with the tie device now secured in the couplers. The relative positions of the coupler pivots 71 and 72 in the coupler guides, control the movement of the couplers to position the tie device around the bars and to bring the hooks together for coupling, with the top of the loop formed resting on the twist rods 73.

The motor is stopped at this position by a microswitch. This switch supplies power to the solenoid 74 causing the solenoid arm 75 to move up to engage the screw shaft 64 with the drive shaft 76 through the clutch mechanism 77.

At the end of the solenoid arm travel, electrical contacts restart the motor in the reverse direction through a polarity relay.

The drive shaft rotates the drive gear 78 and in turn, the twist gear 79 its hollow shaft 80 and the twist rods 73 which are connected to the hollow shaft. The tie device is twisted to form the tie.

During this twisting action, the screw nut and carrier arms move back up the screw shaft releasing the couplers at their original positions through their engage/release catch. The screw nut continues its upward path to engage the shear blade through its engage/release catch and travels a short distance past its original position where the motor is stopped by a microswitch. The reset switch 81 is pressed when the motor stops which restarts the motor in the reverse direction through the polarity relay. This rotates the screw shaft and in turn, the twist rods in the reverse direction to the twisting action, which frees the rods from the tie device to allow the machine to be removed.

The motor is stopped by a microswitch when the shear blade reaches its original position above the front tie device in the magazine. This switch also cuts power to the solenoid which disengages the screw shaft from the drive shaft.

The D.C. motor is powered by rechargeable batteries. Space is available in the motor chamber for the batteries, relays and microswitches. The circuitry is arranged so that the switches cannot operate out of sequence.

An alternative to using microswitches and relays is to use a stepping motor controlled by a microprocessor.

The electromechanical machine, which is depicted in FIG. 9, will hereinafter be described.

A stack of tie devices is placed in the magazine 11 in front of the magazine drive plate 152 and its drive spring 41. The machine is placed diagonally and approximately centrally across the bars 7 and 8 with the saddles 13 resting on the top bar 7 and the coupler guide housing 14 straddling the bars.

The handles 42 are pressed down which moves the frame down. The shear blade or guillotine 67 connected to the frame shears the front tie device 1 from the stack thereof in the magazine 11 and delivers it to the coupler. The shear blade 43 stops at this position, being released from the frame by the engage/release catch 44. At this same position, the coupler pivots 45 are engaged by the coupler drive plates 46 connected to the frame. As the handles continue to be pressed down, the couplers are driven with the tie device now secured in the couplers. The relative positions of the coupler pivots 45 and 47 and in the coupler guides, control the movement of the couplers to position the tie device around the bars 7 and 8 and to bring the hooks thereof together for coupling, with the top of the loop formed resting on the twist rods 48.

The handles and frame are stopped at this position, where a microswitch starts the D.C. gear-motor 49. The D.C. motor 49 rotates the drive gear 50 and in turn, the twist gear 51, its hollow shaft 52 and twist rods 48 connected to the hollow shaft. The twist rods twist the tie device.

An auxilliary threaded shaft 53 is connected to the gear-motor shaft through a set of gears 54. A nut 55 which is restrained from turning, moves up the auxilliary shaft during the twisting action. The nut contacts a microswitch to stop the motor when the tie is completed.

With the tie completed and the twist rods held in the top loop that has been formed, the handles and frames are pulled up to their original positions.

At the end of this upward travel, a microswitch restarts the motor through a polarity relay in the reverse direction. The twist rods spin clear of the tie device and allow the machine to be removed. The nut travels back down the auxilliary shaft to its original position where a microswitch stops the motor. This reverse rotation also returns the hollow shaft and the twist rods to their original positions ready to receive the next tie device 1.

It should be understood from the foregoing description that a wide variety of different electrical, mechanical or electromechanical devices can be implemented to achieve the purpose of the device of the present invention.

It will be understood that one of the important features of the machine is the couplers to connect the hooks of the tie device so that the tie device can be twisted such that it is tied about the objects to be tied.

Details of a suitable coupler arrangement are shown in FIGS. 10 to 13. While there are a number of ways in which the tie devices can be delivered to the bars and twisted, the actual coupling or linking of the hooks together is fundamental and unique to the machine tying.

Referring to FIGS. 10 to 13, operation of the couplers follows.

Each hook is controlled by a coupler. The 'twisted' hook is enclosed by the fixed sides 125 of the coupler, FIG. 11, which holds the hook in the plane of the tie device for coupling. The top plate 126 engages the back of the leg of the tie device. The arm 128 shown in the closed position in FIGS. 11(*d*) and (*f*) secures the base of the tie device which, in conjunction with the other coupler, enables the tie device to be delivered to the bars. The arm is pivoted at 129 and is held closed by the guide rails 130 as shown in FIGS. 11(*c*) and (*f*), acting on it through the castors 131 against the spring 132.

The 'straight' hook is enclosed by the hinged sides 133 of its coupler as shown in FIG. 11, which also holds this hook in the plane of the tie device for coupling. The top plate 134 engages the back of the leg of the tie device. The pin 135 connected to one of the sides 133, shown in the closed position in FIGS. 12(*d*) and (*e*), secures the base of the tie device in the same way as the arm 128 of the other coupler. The sides 133 are pivoted at 136 and held closed by the guide rails 137, see FIGS. 12(*a*) and (*e*), acting on it through the castors 138 against the spring 139.

Controlled by the guide rails, the two couplers approach in the plane of the tie device. The shape of the 'twisted' hook ensures that the 'straight' hook will deflect passed the 'twisted' hook on the correct side to engage. The 'twisted' hook is held firmly in its coupler and does not deflect. The guides of the couplers are narrowed where the 'straight' hook just enters the 'twisted' hook coupler. This causes the arm 128 to rotate clear of its hook and the sides 133 to rotate clear of their hook. FIGS. 11(*b*) and (*g*) and FIG. 12(*b*) and (*f*) show the guide rails narrowed to open the couplers. FIG. 13(*a*) shows the couplers with the 'straight' hook just inside the 'twisted' hook coupler and the couples starting to open. FIG. 13(*b*) shows the hooks ready to engage with the couplers fully open.

The couplers stop when the hooks are ready to engage. The machine mechanism, the twist rods 117 and twist plates 142 fixed to the hollow shaft 116 then twists the loop formed in the tie device to complete the tie. The top of the loop is held by the twist rods, which causes the bottom of the loop (the hooks) to be drawn out of the couplers to the underside of the bars as the loop is twisted. At the same time, the hooks link one behind the other due to the inherent spring in the wire of the tie device. (In the case of electrical machine, the couplers actually move apart as soon as the twisting starts).

Figure 10:
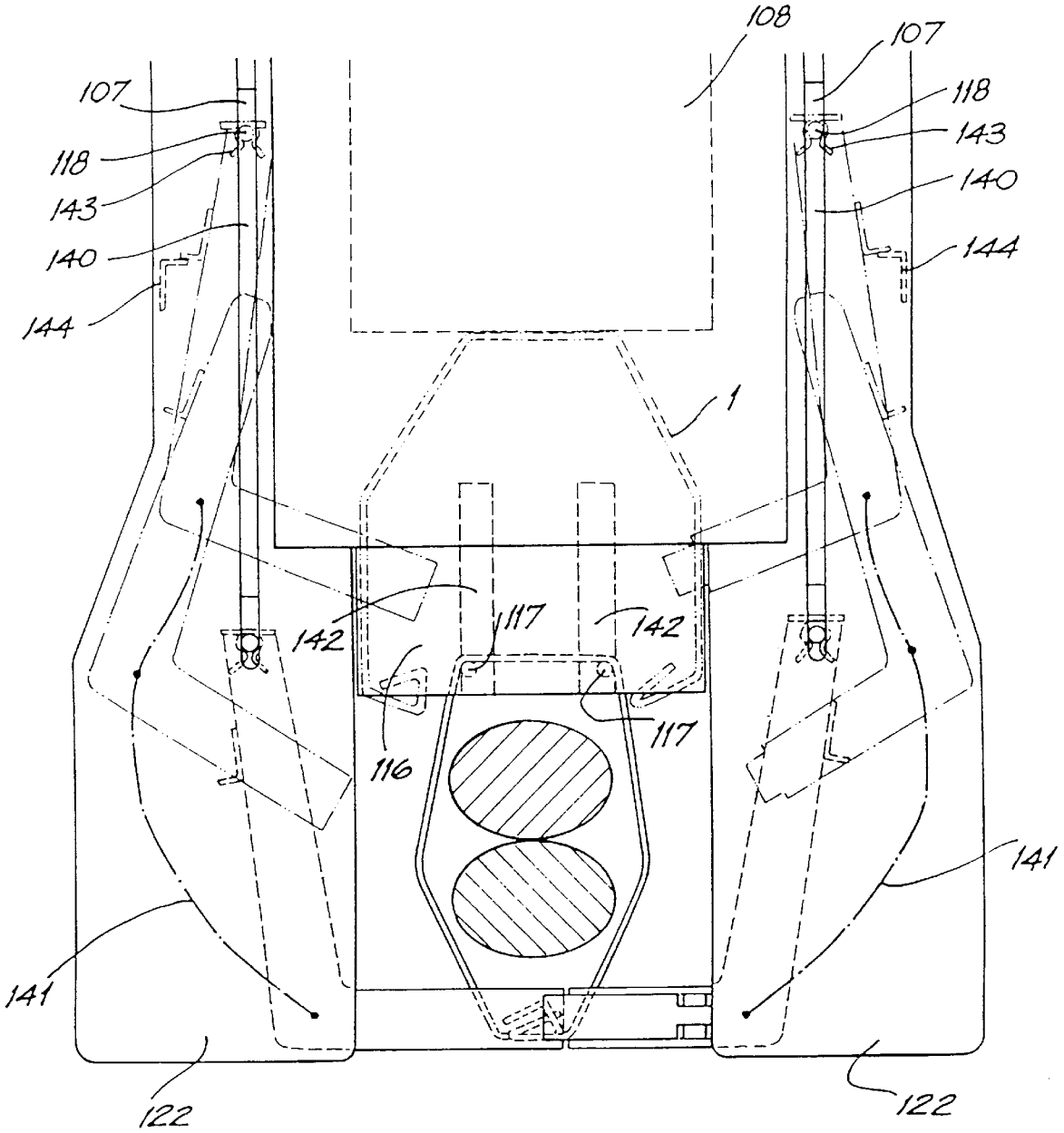
FIG. 10 details the coupler travel in the positioning of a tie device into its twisting position.
Figure 11C:
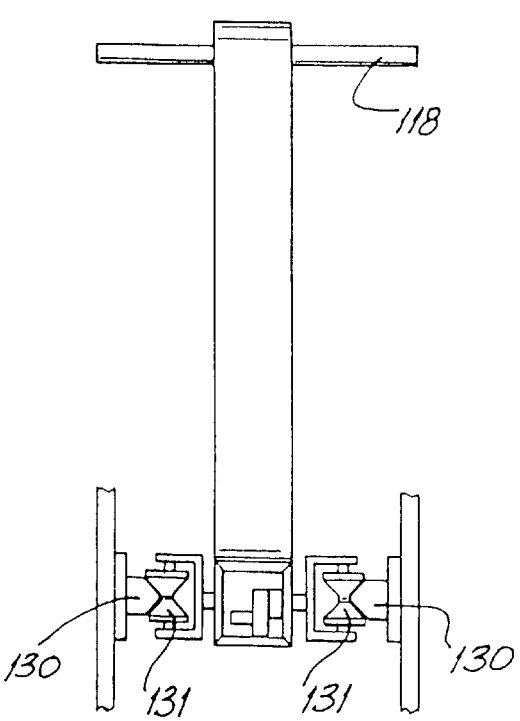
FIG. 11, in FIGS. 11(*a*) through 11(*g*), shows details of a coupler for a 'twisted hook'.
Figure 11B:
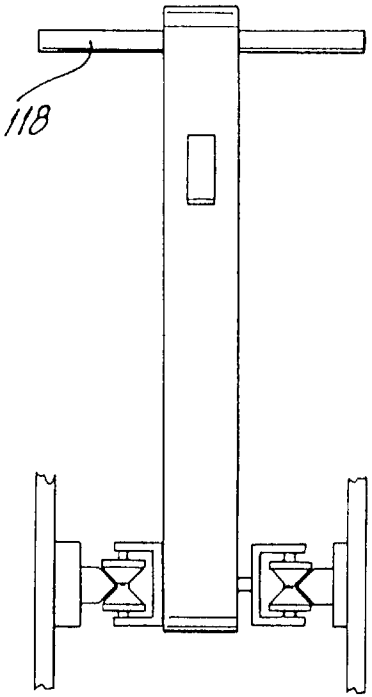
Figure 11A:
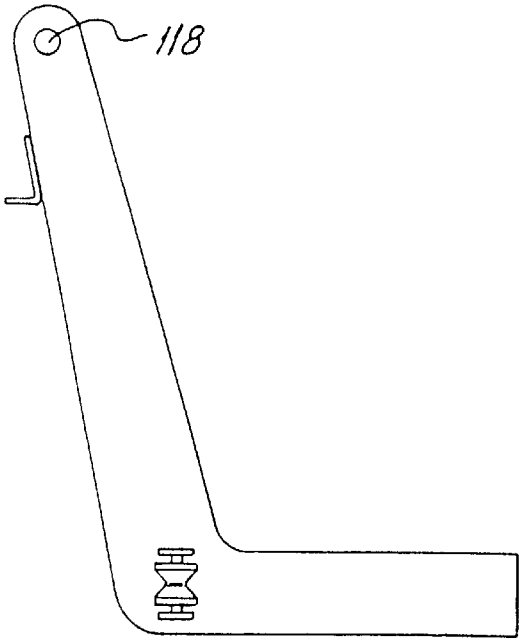
Figure 11D:
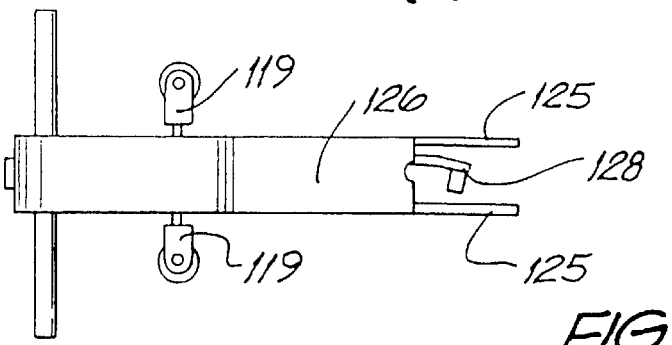
Figure 11E:
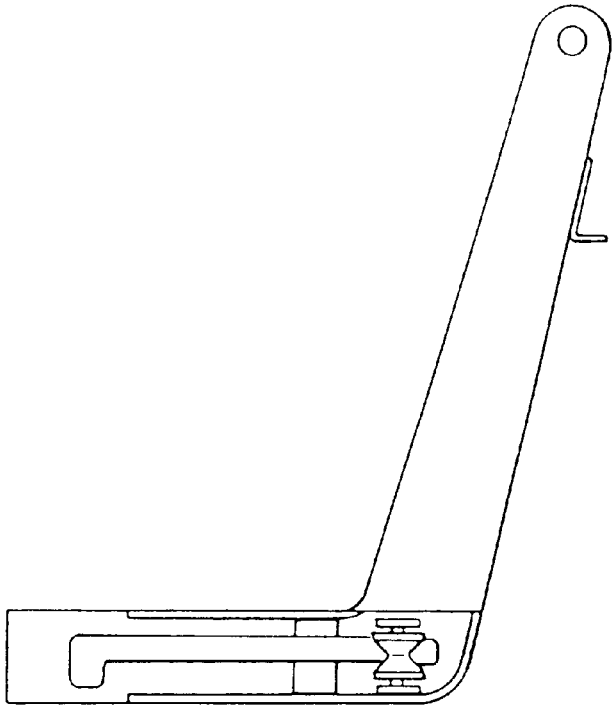
Figure 11F:
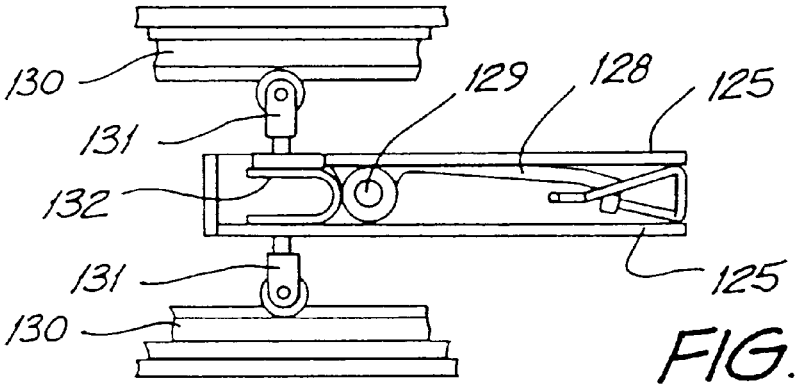
Figure 11G:
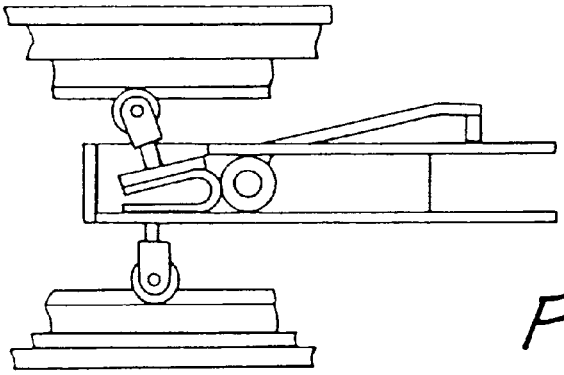
Figure 12C:
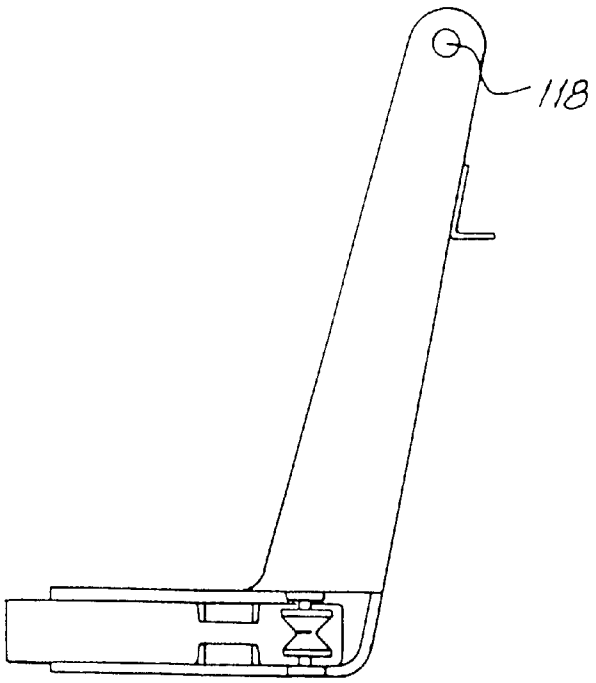
FIG. 12, in FIGS. 12(*a*) through 12(*f*), shows details of a coupler for a 'straight' hook.
Figure 12B:
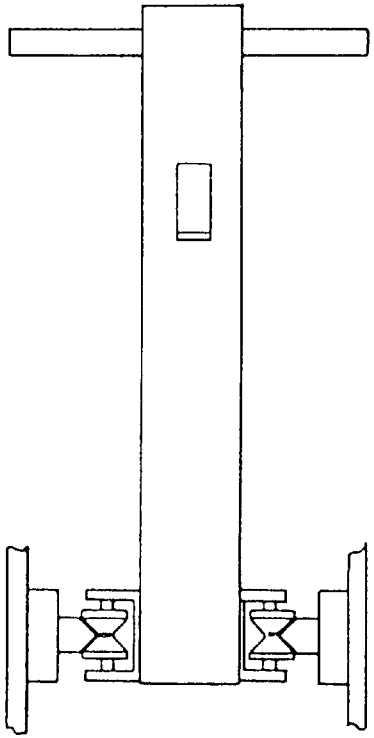
Figure 12A:
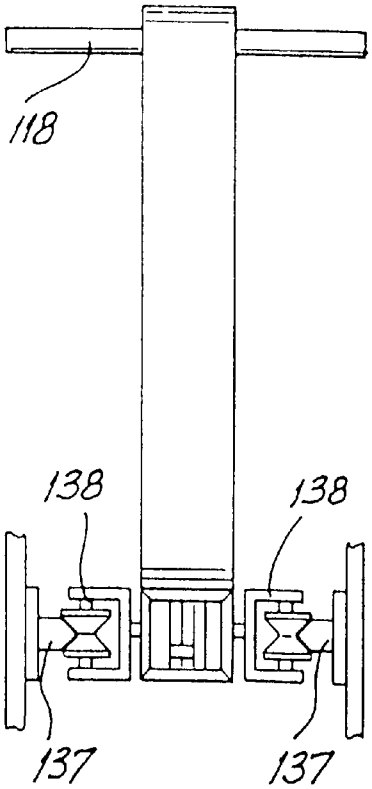
Figure 12E:
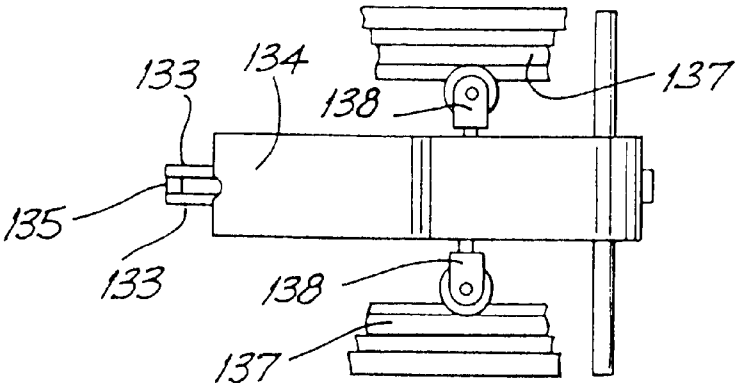
Figure 12D:
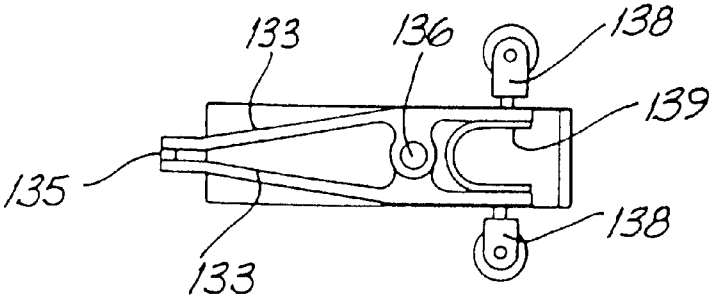
Figure 12F:
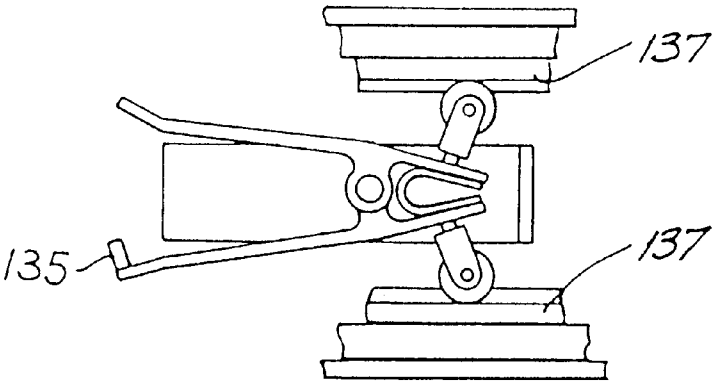

FIG. 10 shows the travel of the couplers from their fully up position ready to receive the tie device, to their fully down position ready to engage the hooks of the tie device. The pivots 118 of the couplers travel vertically in the slots 140 in the coupler guide housing 122. The couplers are open to receive the tie device and close around the legs of the tie device a short distance from this position controlled by the distance apart of the guide rails.

The guide rails 130 and 137 are fixed to the coupler guide housing along the paths 141. The couplers pivot on their castors at 119 which, in conjunction with the pivots 118 control the movement of the couplers as they are pushed down by the coupler drive plates 111, fixed to the bottom frame 17. Clips 143 fixed to the bottom frame, prevent the couplers from free falling. The spring steel catch 144 holds the couplers in their fully up position.

FIG. 10 also shows the tie device 142 delivered to the couplers by the shear blade in the fully up position and the couplers in the fully down position with the hooks ready to engage and the top of the tie device resting on the twist rods 117.

An important factor of this coupler action is that the couplers are approximately the same depth as the tie device, hooks, which means that the couplers can operate in a very small space, much smaller than the clearance normally provided between the bars and the formwork.

It will be understood that a wide variety of modifications achieving the same basic function will become apparent to persons skilled in the art.

Figure 14:
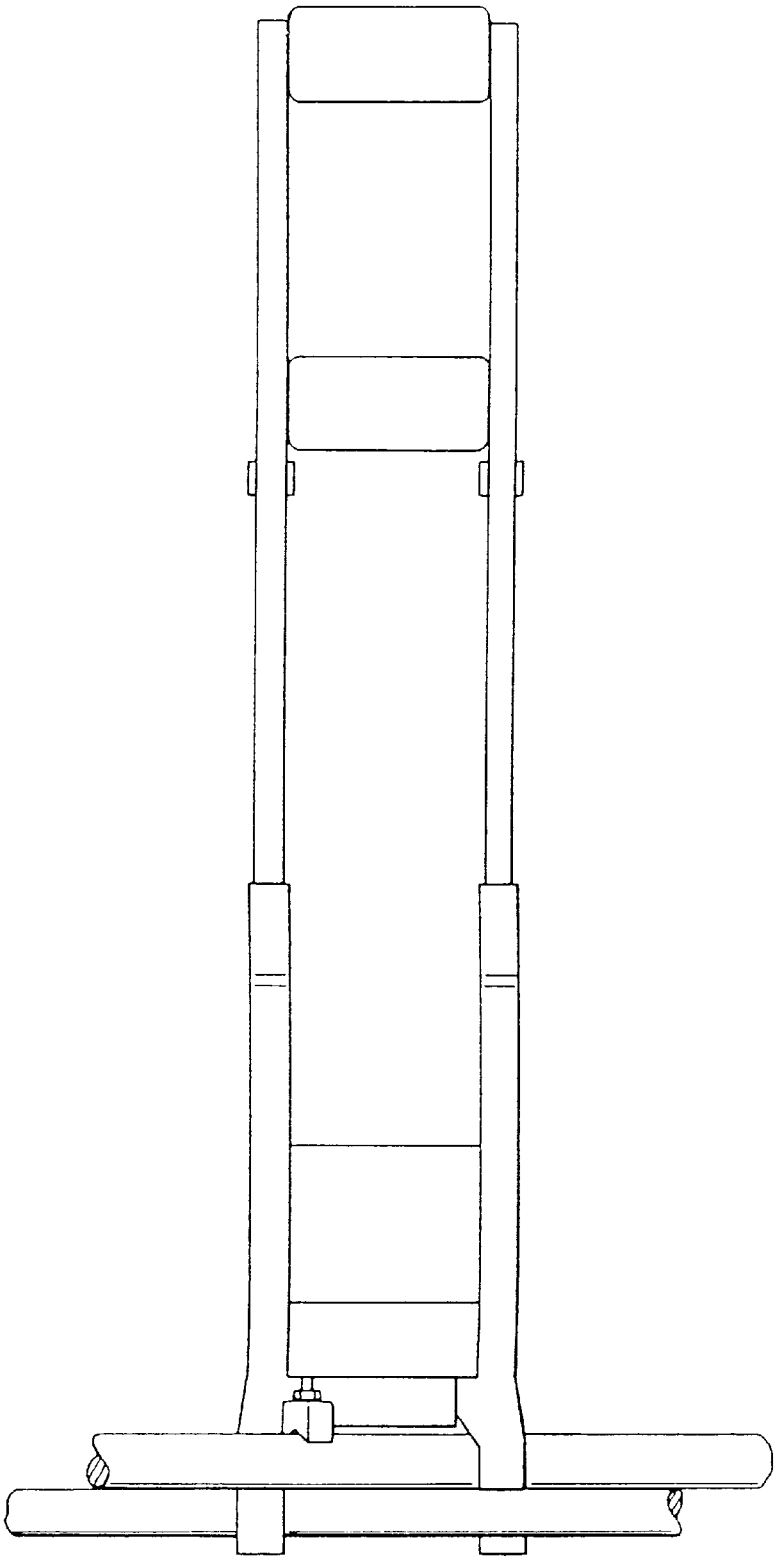

An example of a modification might be to adapt an extension handle to the device. An extension handle of course can be adapted to the device whether it be a mechanical, electrical, or electromechanical version of the machine. A type example of one embodiment of an extension handle is shown in FIG. 14. This enables an operator to access hard to get at areas to tie the reinforcing rods or other objects to be tied, which might be in an elevated or other hard position to reach. Such an extension handle also has the significant advantage of eliminating or at least reducing the amount of bending and/or kneeling by the operator. Such bending and/or kneeling causes damage to the knees and/or backs and/or other portions of an operator's body, which is a serious health concern within the construction industry.

The tying apparatus of the present invention will therefore be understood to be able to be used in a variety of forms. Likewise, it can be used in any orientation, but for the purposes of the description, it will be assumed to be used in the vertical position.

Whilst perhaps the primary application for the present invention is the tying of reinforcement rods in the construction of concrete slabs and the like, other applications for the device will become apparent. For example, the device may be utilised to tie the tops of bags or sacks such as chaff bags, for tying barbed or plain wire to star picket fence posts, for tying K-wire fencing or similar to steel frames, etc. All such applications should be considered to fall within the scope of the invention.

All such variations and modifications which become apparent to persons skilled in the art should be considered to fall within the scope of the invention as hereinbefore described and as hereinafter mentioned.

I claim:

1. A tying apparatus for delivering a tie device positioned in said tying apparatus and for tying said tie device about at least two reinforcing bars, said at least two reinforcing bars having a first side and a second side substantially opposed to said first side, said tie device having a pair of elongated arms in one of a substantially U-shaped and V-shaped configuration and an intermediate portion coupled between said pair of elongated arms, each of said pair of elongated arms having a free end portion including a hook means, said tying apparatus comprising:

a frame;

delivering means to accept at least one tie device, said delivering means coupled to said frame;

connecting means coupled to said frame; and twisting means coupled to said frame, said twisting means including at least one of a twist rod and a twist plate disposed substantially perpendicular to said position of a tie device in said tying apparatus, wherein said delivering means is adapted to deliver said tie device to said connecting means as an accepted tie device, wherein said connecting means is adapted to deliver said accepted tie device to a tying position about said twist rod or said twist plate and said reinforcing bars, such that said intermediate portion of said tie device is adjacent to said twist rod or said twist plate, and said hook means are provided beyond said second side of said reinforcing bars complimentary to each other as complimentary hook means, and further wherein said connecting means interengages said hook means when said tie device is in said tying position, and wherein said twisting means is adapted to operatively engage said tie device about said intermediate portion of said tie device at a twist position and adapted to twist said tie device substantially about said twist position by rotating said twist rod or said twist plate such that the security of the interengagement of said hook means of said tie device increases as said twist rod or said twist plate is twisted.

2. The tying apparatus of claim 1, wherein said delivering means includes:

a handle displaceably coupled to said frame, said handle having a bottom portion and a first position and a second position;

a cantilever blade coupled to said bottom portion of said handle; and a magazine, said magazine adapted to accept a plurality of stacked tie devices, wherein said cantilever blade is adapted to displace one of said plurality of stacked tie devices from within said magazine to said connecting means as a displaced tie device when said handle is actuated from said first position to said second position.

3. The tying apparatus of claim 2, wherein said twisting means further comprises a twist gear coupled to said twist rod or said twist plate and rotatably coupled to said handle, said twist gear rotated in one direction when said handle is actuated from said first position to said second position, and in a substantially opposite direction when said handle is actuated from said second position to said first position.

4. The tying apparatus of claim 2, wherein said connecting means comprises a pair of couplers displaceably coupled to said frame, said couplers having a first position and a second position, wherein in said first position, each coupler is adapted to grip an arm of said displaced tie device, and wherein in said second position, each coupler is adapted to displace said hook means of each arm of said displaced tie device to interengage said complimentary hook means.

5. The tying apparatus of claim 1, wherein at least one of said delivering means, said connecting means, and said twisting means is electrically operated.

6. The tying apparatus of claim 1, wherein at least one of said delivering means, connecting means, and twisting means is pneumatically operated.

7. The tying apparatus of claim 1, wherein at least one of said delivering means, connecting means, and twisting means is hydraulically operated.

8. A method of binding at least two reinforcing bars together, comprising:

providing a tying apparatus having a displaceable tie device positioned in said tying apparatus, said displaceable tie device having an intermediate portion, said tying apparatus adapted to deliver and tie said displaceable tie device about said at least two reinforcing bars, said displaceable tie device having a pair of elongated arms in one of a substantially U-shaped and V-shaped configuration and having an intermediate portion coupled between said pair of elongated arms and each elongated arm having an end portion, said pair of elongated arms having a complimentary hook means at said end portions thereof, said tying apparatus including:

delivering means adapted to accept said displaceable tie device as an accepted tie device and adapted to deliver said accepted tie device to a connecting means, said connecting means adapted to deliver said accepted tie device to a tying position about said at least two reinforcing bars and adapted to interengage said complimentary hook means of said accepted tie device, and twisting means coupled to a frame, said twisting means including at least one of a twist rod and a twist plate disposed substantially perpendicular to said position of said displaceable tie device in said tying apparatus, said twisting means adapted to twist said intermediate portion of said accepted tie device by rotating said twist rod or said twist plate;

positioning said accepted tie device about a first side of said at least two reinforcing bars such that said complimentary hook means are positioned on a second side of said bars;

interengaging said complimentary hook means; and twisting said intermediate portion of said displaceable tie device by rotating said twist rod or twist plate to operatively engage said intermediate portion of said accepted tie device and twist and tighten said accepted tie device about said at least two reinforcing bars, the security of the interengagement of said complimentary hook means increasing as said accepted tie device is twisted.

9. The method of claim 8, wherein said delivering means is adapted to deliver said accepted tie device from a magazine having a plurality of tie devices.

10. The method of claim 8, wherein said connecting means comprises a pair of couplers displaceably coupled to said frame, said couplers having a first position and a second position, wherein in said first position, each coupler is adapted to grip an arm of said displaceable tie device, and wherein in said second position, each coupler is adapted to displace said complimentary hook means of each arm of said displaceable tie device to interengage said complimentary hook means.

11. The method of claim 8, wherein at least one of said delivering means, connecting means, and twisting means of said tying apparatus is electrically operated.

12. The tying method of claim 8, wherein at least one of said delivering means, connecting means, and twisting means is pneumatically operated.

13. The method of claim 8, wherein at least one of said delivering means, connecting means, and twisting means is hydraulically operated.

* * * * *

UNITED STATES PATENT AND TRADEMARK OFFICE

CERTIFICATE OF CORRECTION

PATENT NO. : 5,913,341
DATED : June 22, 1999
INVENTOR(S) : Jones

It is certified that error appears in the above-identified patent and that said Letters Patent is hereby corrected as shown below:

Item [75] "Wynnum, Australia" and insert -- Wynnum, Queensland, Australia --.

Figure 13A:
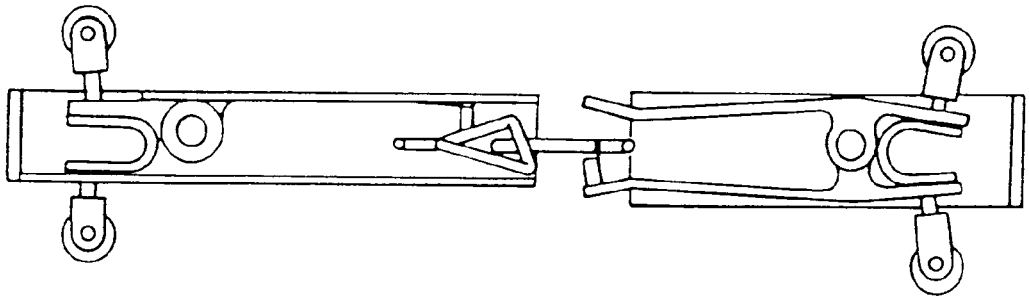
FIG. 13, in FIGS. 13(*a*) through 13(*b*), shows operation of the hooks of the tie device being engaged by the couplers; and, FIG. 14 shows a tying apparatus having an extension handle thereon.
Figure 13B:
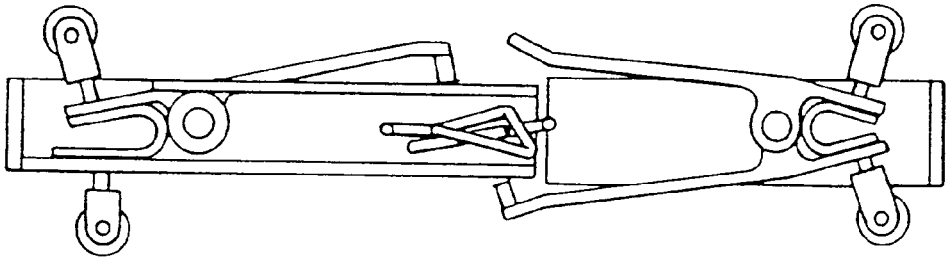

Column 3,
Line 54, delete "FIGS. 13(a) through 13(b)" and insert -- FIGS. 13(a) and 13(b) --.

Column 12,
Line 16, delete "The tying method" and insert -- The method --

Signed and Sealed this

Fourteenth Day of August, 2001

*Attest:*

Nicholas P. Godici

*Attesting Officer*

NICHOLAS P. GODICI
*Acting Director of the United States Patent and Trademark Office*